US007731908B2

(12) United States Patent
Lenz

(10) Patent No.: US 7,731,908 B2
(45) Date of Patent: Jun. 8, 2010

(54) PIPETTE

(75) Inventor: Jurgen Lenz, Grossbottwar (DE)

(73) Assignee: Eppendorf AG, Hamburg (DE)

( * ) Notice: Subject to any disclaimer, the term of this patent is extended or adjusted under 35 U.S.C. 154(b) by 1022 days.

(21) Appl. No.: 11/387,618

(22) Filed: Mar. 23, 2006

(65) Prior Publication Data

US 2006/0263261 A1 Nov. 23, 2006

(30) Foreign Application Priority Data

May 20, 2005 (DE) ..... 10 2005 023 203

(51) Int. Cl.
*B01L 3/02* (2006.01)

(52) U.S. Cl. ..... 422/100; 73/864.14

(58) Field of Classification Search ..... 422/100; 73/864.14

See application file for complete search history.

(56) References Cited

U.S. PATENT DOCUMENTS

| | | | | |
|---|---|---|---|---|
| 4,406,170 | A * | 9/1983 | Kuhn | 73/864.16 |
| 5,620,660 | A * | 4/1997 | Belgardt et al. | 422/100 |
| 5,747,709 | A * | 5/1998 | Oshikubo | 73/864.18 |
| 6,540,964 | B2 * | 4/2003 | Kohrmann et al. | 422/100 |

FOREIGN PATENT DOCUMENTS

| | | | |
|---|---|---|---|
| DE | 29 26 691 | A1 | 6/1981 |
| DE | 43 41 229 | A1 | 6/1995 |
| DE | 199 17 907 | C2 | 8/2001 |

* cited by examiner

*Primary Examiner*—Jan M Ludlow
(74) *Attorney, Agent, or Firm*—Vidas, Arrett & Steinkraus, P.A.

(57) ABSTRACT

A pipette, comprising a pipette casing which has disposed therein a seat, a piston seat in an accommodating body, mounting devices for reversibly fixing the mounting portion and syringe piston of a syringe within the seats and piston adjusting devices for displacing the accommodating body, wherein the mounting portion and syringe piston are adapted to be slid to their mounting positions through axial apertures, the mounting devices have radially advanceable gripping devices, the gripping devices have syringe gripping levers pivotally supported within the pipette casing and piston gripping levers pivotally supported within the accommodating body, the syringe gripping levers and piston gripping levers have two arms, the syringe gripping levers, at the insides of their actuator arms, having contact points which when their actuator arms are actuated are adapted to be externally pivoted against the actuator arms of the piston gripping levers, the syringe gripping levers have inwardly projecting release levers on the actuator arms, a transfer element which is slidably guided transversely with respect to the release levers within the pipette casing is adapted to be brought into abutment against the two release levers by being shifted by a front-end sided abutment area, and a trigger displaceable within the pipette casing is coupled to the transfer element to displace the transfer element upon displacement of the trigger.

19 Claims, 1 Drawing Sheet

PIPETTE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a pipette.

Pipettes are devices for metering and transferring liquids. They frequently are configured as repeat pipettes or multi-pipettes which allow to dispense a liquid from a syringe in a stepwise manner. A repeat pipette of this type has been known from DE 29 26 691 C2, which is specifically directed to the repeat mechanism of the repeat pipette. The document also describes how to fix a syringe of the system to the repeat pipettes. For this purpose, the syringe has a syringe flange which is adapted to be introduced from a side into a groove which is open laterally and substantially is U-shaped. The syringe flange inserted is fixed in the groove by an axial pressure spring. An insertion element is provided to join the syringe piston to a piston adjusting device and accommodates an end portion of the syringe piston between two jaws. The jaws are designed to be pressed against the syringe piston by means of a flap-shaped clamping member the actuation lever of which protrudes from the casing through an opening. This syringe fixation has the drawback that the syringe needs to be seized in order to insert and couple it to the piston adjusting device and uncouple and remove it therefrom.

DE 43 41 229 C2 proposes a pipette system which is suited better for manual actuation and has a syringe which simply may be pushed into the pipette and removed therefrom axially. This pipette has a syringe exhibiting a mounting portion and a syringe piston, and a pipette which has a seat for the mounting portion in a pipette casing and an accommodating body with a piston seat for the syringe piston. Further, there are mounting devices for reversibly fixing the mounting portion and syringe piston in the seats and piston adjusting devices for the displacement of the accommodating body within the pipette casing. The mounting portion and the syringe piston can be axially pushed into their mounting positions through axial apertures of their seats. The mounting devices have radially advanceable gripping devices for fixing the mounting portion and syringe piston in the mounting positions. The gripping devices have syringe gripping levers pivotally supported within the pipette casing and piston gripping levers pivotally supported within the accommodating body. The syringe gripping levers and piston gripping levers are configured to have two arms including a gripper arm and an actuator arm where the syringe gripping levers, at the insides of their actuator arms, have contact points which when their actuator arms are actuated are adapted to be externally pivoted against the actuator arms of the piston gripping levers and actuate the piston gripping levers. The effect achieved is that the syringe and pipette can be connected to each other by a purely axial relative movement and can be disconnected from each other by an actuation of the mounting devices.

According to an embodiment, a user wanting to disconnect the syringe from the pipette is required to press the actuator arms of two syringe gripping levers inwardly. As a result, the gripping arms let the syringe flange go while the unlocking cams of the syringe gripping levers exert a force on the actuator arms of the syringe gripping levers so that those let the syringe piston go. Pre-loaded spiral-coiled springs of a flange stop apply a pressure towards the axial aperture of the repeat pipette to eject the syringe. For a separation of the syringe from the pipette, it is necessary to actuate the two syringe gripping levers by two fingers simultaneously.

Accordingly, it is the object of the invention to provide a pipette in which the syringe can be released from the pipette by an actuation of only a single trigger.

BRIEF SUMMARY OF THE INVENTION

The inventive pipette has a pipette casing which has disposed therein, a seat for the mounting portion of a syringe cylinder of a syringe, a piston seat in an accommodating body for a syringe piston of the syringe, mounting devices for reversibly fixing the mounting portion and syringe piston within the seats, and piston adjusting devices for displacing the accommodating body within the pipette casing, wherein the mounting portion and syringe piston are adapted to be axially slid to their mounting positions through axial apertures of their seats, the mounting devices have radially advanceable gripping devices for fixing the mounting portion and syringe piston in the mounting positions, the gripping devices have syringe gripping levers pivotally supported within the pipette casing and piston gripping levers pivotally supported within the accommodating body, the syringe gripping levers and piston gripping levers are configured to have two arms including a gripper arm and an actuator arm, the syringe gripping levers, at the insides of their actuator arms, have contact points which when their actuator arms are actuated are adapted to be externally pivoted against the actuator arms of the piston gripping levers and actuate the piston gripping levers, the syringe gripping levers have inwardly projecting release levers on the actuator arms, a transfer element which is slidably guided transversely with respect to the release levers within the pipette casing in at least one guide is adapted to be brought into abutment against the two release levers by being shifted by device of a front-end sided abutment area within the guide, and a trigger displaceably disposed within the pipette casing is coupled to the transfer element to displace the transfer element within the guide upon displacement of the trigger.

The inventive pipette has the advantage that it is possible to separate a syringe from the pipette by actuating a single, central trigger. Indeed, an actuation of the trigger results in a displacement of the transfer element coupled thereto within the guide. Here, the transfer element hits the abutment area onto the release levers, pivoting them and the syringe gripping levers as well. As a consequence, the syringe gripping levers liberate the mounting portion of the syringe. At this stage, the syringe gripping levers are pivoted against the actuator arms of the piston gripping levers, causing them to let the syringe piston go at a slight time lag. Thus, an actuation of a single trigger causes a separation of the syringe from the pipette. This maintains the beneficial axial connectability of the syringe to the pipette. If the pipette is designed in an appropriate way such axial connectability can be brought about by merely fitting the pipette onto the mounting portion and syringe piston of the syringe.

According to an aspect, the trigger mechanism defined by the release lever, transfer element, and trigger is adapted to be shifted between two end positions wherein the syringe is fixed on the pipette in a mounting position and is released from the pipette in a release position. For this purpose, according to an aspect, the trigger mechanism is provided with end stops.

According to another aspect, a spring member is provided which acts onto the trigger mechanism at one end and onto the pipette casing at the other end, so that the spring member counteracts a trigger actuation. Here, the spring member is chosen and dimensioned so as to move the trigger mechanism back to the mounting position following the liberation of the trigger.

According to an aspect, the transfer element is guided within the guide in parallel with the direction of displacement of the accommodating body within the pipette casing. This favours a space-saving accommodation in the pipette casing and an arrangement of the trigger in a region of the pipette casing that is remote from the seat.

According to an aspect, the transfer element has at least two parallel rods guided within the guides and bridging members that connect them at the ends. The transfer element is adapted to receive a repeat mechanism and/or other components between the rods. According to another aspect, at least one bridging member facing the release levers exhibits the abutment area.

According to an aspect, the transfer element is joined to a trigger laterally projecting from the pipette casing transversely to the guide. The trigger can be conveniently actuated without gripping around it by the thumb which also actuates the repeat mechanism, specifically when the trigger is disposed close to that end of the pipette casing which faces away from the seat.

According to an aspect, the trigger is disposed in the vicinity of that end of the pipette casing which is remote from the seat. This makes it easier to operate the trigger.

According to an aspect, the transfer element is joined to the trigger via an actuation rod. The actuation rod serves for joining the transfer element to the trigger in a space-saving fashion close to that end of the pipette casing which faces away from the seat.

According to an aspect, each syringe gripping lever has two release levers. The two release levers favour a uniform transfer of the releasing force into the syringe gripping levers at a space-saving accommodation.

According to an aspect, the release levers, when in a non-actuated condition, are inclined at an acute angle from the guide of the transfer element. This favours a uniform transfer of the releasing forces into the syringe gripping levers from the transfer element throughout the pivoting region of the syringe gripping levers.

According to an aspect, the release levers exhibit rounded corners. The rounded corners are capable of rolling down on the abutment area of the transfer element at a low friction and, thus, will save forces.

According to an aspect, the seat has disposed therein a spring-loaded abutment onto which the mounting portion of the syringe is adapted to be pressed by the syringe gripping levers. Upon liberation by the syringe gripping levers, the syringe will be knocked out of the seat by the spring-loaded abutment. For example, the spring-loaded abutment is formed by a spring-loaded sensor plate for sensing by device a code formed by elevations and depressions on the mounting portion of the syringe.

According to an aspect, the trigger has a trigger button which outwardly projects from the pipette casing and is adapted to be displaced via a manual actuation.

According to an aspect, the pipette has an electric driving motor for the trigger that is coupled to the trigger. The trigger and, hence, the separation of the syringe from the pipette are controllable by controlling the electric driving motor.

According to an aspect, the pipette has an electric driving motor for the piston adjusting device that is coupled to the piston adjusting device. In this aspect, the displacement of the piston is controllable electrically.

It is understood that the pipette including an electric driving motor for the trigger and/or for the piston adjusting device has an electric control unit and an electric voltage supply for the driving motor or motors. The electric voltage supply is a mains voltage supply and/or a voltage supply using an accumulator or battery.

According to an aspect, the pipette is a hand-operated pipette, i.e. it is carried in a hand when in use. To this end, it is preferred to design the pipette casing as a handle. The trigger and/or piston adjusting device are driven manually and/or via an electric motor here.

According to another aspect, the pipette is a stationary pipette. It is preferred to drive the trigger and/or piston adjusting device via an electric motor here.

BRIEF DESCRIPTION OF THE SEVERAL VIEWS OF THE DRAWINGS

The invention will be described in more detail below with reference to the accompanying drawings of an embodiment. In the drawings.

DETAILED DESCRIPTION OF THE INVENTION

Figure 1:
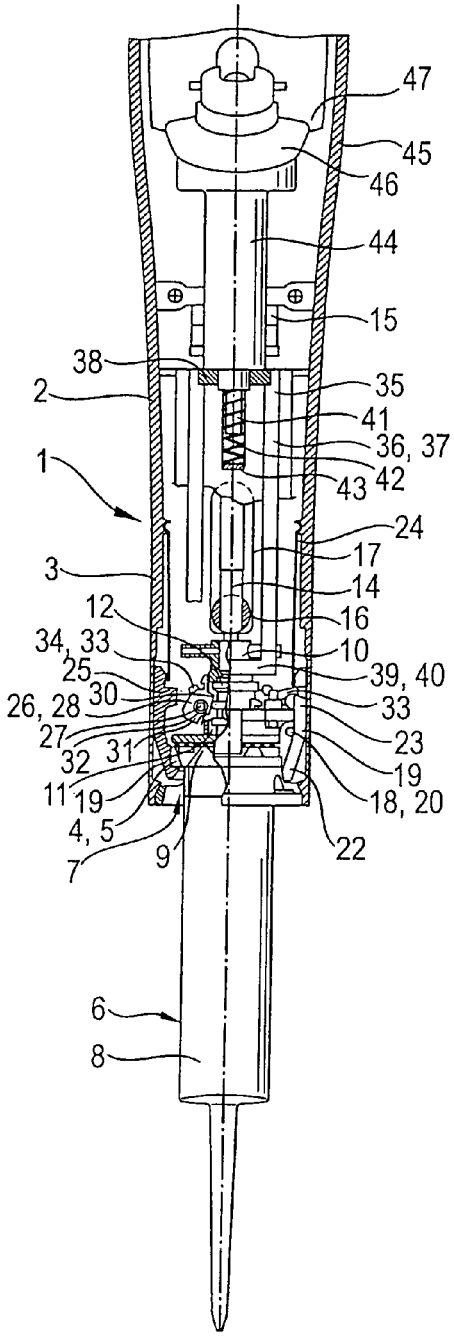
FIG. 1 shows a pipette with a syringe retained therein, in a longitudinal section (left-hand half) and with a half of the casing dismounted (right-hand half)

While this invention may be embodied in many different forms, there are described in detail herein a specific preferred embodiment of the invention. This description is an exemplification of the principles of the invention and is not intended to limit the invention to the particular embodiment illustrated The terms "bottom", "below", and "top", "above" hereinafter will refer to the orientation of the pipette when used with the syringe held downwards.

The pipette 1 has a pipette casing 2 with a substantially cylindrical casing bottom 3. The lower end portion of the casing bottom 3 has disposed therein a seat 4 for a syringe flange 5 of a syringe 6. The syringe flange 5 is a mounting portion of the syringe 6. At the lower end of the casing bottom 3, the seat 4 has an axial aperture 7 through which the syringe 6 retained in the seat 4 makes protrude its syringe cylinder 8.

The seat 4 has disposed therein a spring-loaded abutment 9 against which the upper side of the syringe flange 5 can be pressed. The abutment 9 has sensors, which are not shown, for sensing a code at the upper side of the syringe flange 5.

The casing bottom 3 has disposed therein an accommodating body 10 including a piston seat 11 into which an upwardly projecting end portion of a syringe piston 12 of the syringe 6 can be inserted. Here, the syringe piston 12 extends into the accommodating body 10 through an axial aperture 13 of the piston seat 11. The upper end of the syringe piston 12 abuts against a piston stop which is defined by a bottom of the piston seat 11.

The accommodating body 10 is fixed to an elevating rod 14 which is joined to a piston adjusting device 15. For example, the piston adjusting device 15 is a linear drive which is driven manually or by an electric motor, or a piston adjusting device 15 having a repeat mechanism as has been known from DE 29 26 691 C2 or DE 43 41 229 C2. Regarding the explanations for the repeat mechanism, reference is made to the two aforementioned documents.

The elevating rod 14 is coupled to a backward moving lever 16 which outwardly extends from an axial slot 17 of the casing bottom 3. Thus, the accommodating body 10 is axially displaceable within the casing bottom 3 by an actuation of the backward moving lever 16.

Diametrically opposite bearings 18 on either side of the seat 4 have supported therein syringe gripping levers 19 on pivot axis 20 in the casing bottom 3 to fix the syringe flange 5 in the seat 4. The syringe gripping levers 19 are enclosed by the casing 2. The syringe gripping levers 19 are provided with hook-shaped gripper ends 21 which enable the levers to grip behind the lower side of the syringe flange 5 when the latter is inserted into the seat 4 and holds against the abutment 9.

The syringe gripping levers 19 are arranged with a gripper arm 22 below the pivot axis 20. An actuator arm 23 of the syringe gripping levers 19 is located above the pivot axis 20.

The inner shell of the casing bottom 3 has arranged thereon two leaf springs 24 the upper ends of which are fixed to the casing bottom 3. The lower ends of the leaf springs 24 press against the insides of the syringe gripping levers 19.

Hence, the leaf springs 24 cause the syringe gripping levers 19 to be biased towards the position that grips behind the syringe flange 5.

At the insides of their actuator arms 23, the syringe gripping levers 19 carry an unlocking cam 25 each which is directed towards the accommodating body 10.

The accommodating body 10 is provided with through holes 26 at diametrically opposite sides. Those through holes 26 support piston gripping levers 28 on pivot axes 27 on the accommodating body 10. The piston gripping levers 28 are capable of gripping behind a piston collar 29 at the outer end of the syringe piston 12. For this purpose, the levers have an approximately wedge-shaped gripper end 30 which is disposed above the pivot axis 27. An actuation end 31 is located below the pivot axis 27. All of the piston gripping levers 28 exhibit an approximately rhomboidal contour.

The gripping levers 19, 28 have lever arms of about the same length each. However, the piston gripping levers 28 are shorter than are the syringe gripping levers 19.

The pivot axes 27 of the piston gripping levers 28 have arranged thereon leg springs 32 which bias the piston gripping levers 28 towards a position in which they grip behind the piston collar 29. The outside of the actuation ends 31 of the piston gripping levers 28 is shaped so as to be located within the pivoting range of the unlocking cams 25 at the inside of the syringe gripping levers 19 in this locked position. The correct orientation of the piston gripping levers 28 to the syringe gripping levers 19 is ensured by the backward moving lever 16 being guided within the axial slot 17.

Release levers 33 project inwardly from the insides of the actuator arms 23 of the syringe gripping levers 19. The release levers 33 are joined to the upper ends of the actuator arms 23 and are inclined at an acute angle from the axis of the syringe piston 12.

The release levers 33 have roundings 34 at the ends.

A transfer element 35 is arranged within the pipette casing 2. The transfer element 35 has a plurality of rods 36 which are extended in parallel with the axis of the syringe piston 12 and are passed along in guides 37 within the pipette casing 2. The rods 36 are interconnected by bridging members 38, 39 at the ends. The bridging member 39 has an abutment area 40 at bottom. If the transfer element 35 is displaced within the guides 37 it becomes possible to hold the abutment area 40 against the roundings 34 of the release levers 33.

A transfer element 35 is arranged within the pipette casing 2. The transfer element 35 has a plurality of rods 36 which are extended in parallel with the axis of the syringe piston 12 and are passed along in guides 37 within the pipette casing 2. The rods 36 are interconnected by bridging members 38, 39 at the ends. The bridging member 38 has an abutment area 40 at bottom. If the transfer element 35 is displaced within the guides 37 it becomes possible to hold the abutment area 40 against the roundings 34 of the release levers 33.

The bridging member 38 has a trunnion 41 which is oriented in parallel with the axis of the piston 12. A coil spring 42 is guided on the trunnion 41 and is supported by the lower side of the bridging member 38 and is supported by an abutment 43 fixed to the casing, at the other end.

At its top, the transfer element 35 is coupled to an actuation rod 44 which is passed along the inside of the pipette casing 2. The actuation rod 44 is connected above to a laterally projecting trigger button 46 within the casing top 45. The trigger button 46 laterally projects outwardly from the pipette casing 2 through a pocket 47. The trigger button 46 is arranged near the upper end of the pipette casing 2 and, thus, near further control elements which are not shown, e.g. those for the piston adjusting device 15 and the volume to be proportioned.

The pipette 1 is used as follows:

The accommodating body 10 is shifted as far as is possible towards the seat 4, using the backward moving lever 16. A syringe 6 is introduced into the seat 4, with the upper end of the syringe piston 12 and the flange 5 ahead, through the axial aperture 7. At this stage, the upper end of the syringe piston 12 plunges into the piston seat 11 of the accommodating body 10 and the syringe flange 5 is forced against the spring-loaded abutment 9. As a result, the syringe gripping levers 19 and piston gripping levers 28 are urged outwardly against the spring action and, because of the spring action, will then cause their gripper ends 21 to snap behind the syringe flange 5 and their gripper ends 30 to snap behind the piston collar 29. After this, the syringe 6 is fixed within the seat (cf. FIG. 1).

Shifting the backward moving lever 16 towards the top allows to draw liquid into the syringe 6. A proportioning volume is set via suitable adjusting devices. An actuation of the piston adjusting devices 15 causes the syringe piston 12 to move downwards and the desired liquid volume to be dispensed.

When the syringe 6 has been emptied the piston seat 10 is in its lowermost position in which the piston gripping levers 28 can be actuated by an actuation of the syringe gripping levers 19.

Figure 2:
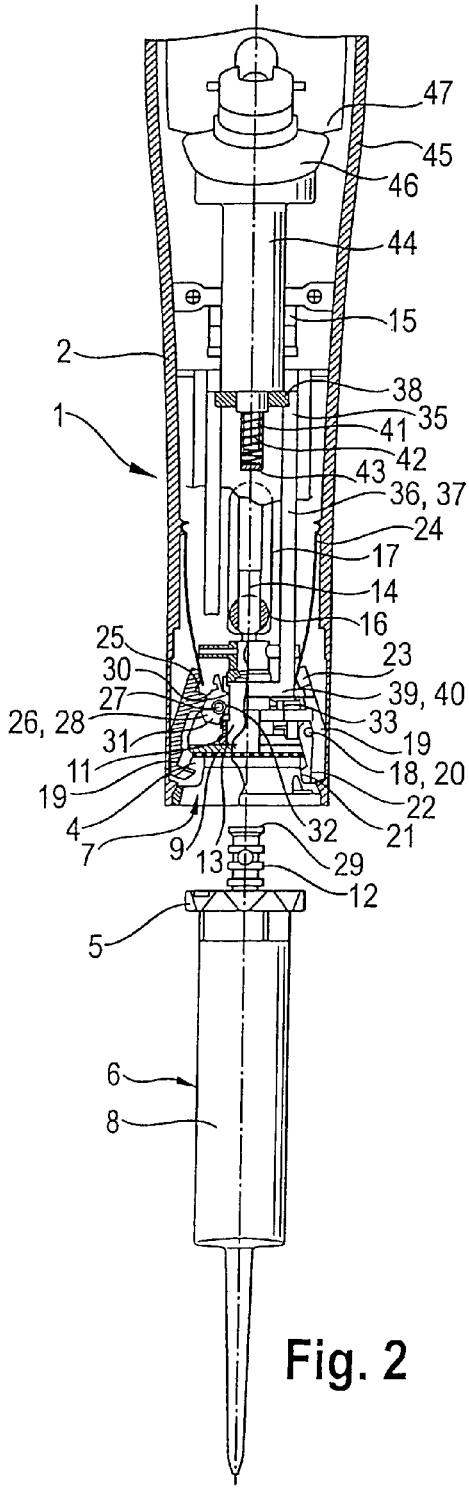
FIG. 2 shows the same pipette with mounting device actuated, in a longitudinal section (left-hand half) and with a half of the casing dismounted (right-hand half).

Once proportioning is performed the syringe 6 may be thrown off by an actuation of the trigger button 46. To do so, the trigger button 46 is pressed down by its user (cf. FIG. 2). This causes the actuation rod 44 and the transfer element connected thereto to move downwards against the action of the coil spring 42. When the abutment area 40 hits upon the release levers 33 the syringe gripping levers 19 will pivot their gripper ends 21 outwardly and liberate the syringe flange 5. The unlocking cams 25 at the insides of the actuator arms 23 externally hit against the actuator ends 31, pivoting the gripper ends 30 of the piston gripping levers 28 outwardly so that the levers release the piston collar 29. The spring-loaded abutment 9 forces the syringe flange 5 downwards and throws the syringe 6 off the pipette.

After the trigger button 46 is released the trigger mechanism 35, 44, 46 and the gripping levers 19, 28 return to their initial positions (cf. FIG. 1) because of the action of the springs 42, 24, 32.

The pipette 1 will then be ready to receive a fresh syringe 6.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pipette, comprising a pipette casing (2) which has disposed therein, a seat (4) for the mounting portion (5) of a syringe cylinder (8) of a syringe (6), a piston seat (11) in an accommodating body (10) for a syringe piston (12) of the syringe (6), mounting devices (19, 28) for reversibly fixing the mounting portion (5) and syringe piston (12) within the seats (14, 11), and piston adjusting devices (15) for displacing the accommodating body (10) within the pipette casing (2), wherein the mounting portion (5) and syringe piston (12) are adapted to be axially slid to their mounting positions through axial apertures (7, 13) of their seats (4, 11), the mounting devices (19, 28) have radially advanceable gripping devices for fixing the mounting portion (5) and syringe piston (12) in the mounting positions, the gripping devices have syringe gripping levers (19) pivotally supported within the pipette casing and piston gripping levers (28) pivotally supported within the accommodating body (10), the syringe gripping levers (19) and piston gripping levers (28) are configured to have two arms including a gripper arm (21, 30) and an actuator arm (23, 31), the syringe gripping levers (19), at the insides of their actuator arms, have contact points (25) which when their actuator arms (23) are actuated are adapted to be externally pivoted against the actuator arms (31) of the piston gripping levers (28) and actuate the piston gripping levers (28), the syringe gripping levers (19) have inwardly projecting release levers (33) on the actuator arms (23), a transfer element (35) which is slidably guided transversely with respect to the release levers (33) within the pipette casing (2) in at least one guide (37) is adapted to be brought into abutment against the two release levers (33) by being shifted by a front-end sided abutment area (40) within the guide (37), and a trigger (46) displaceably disposed within the pipette casing (2) which is coupled to the transfer element (35) to displace the transfer element (35) within the guide (37) upon displacement of the trigger (46).

2. The pipette as claimed in claim 1 wherein a trigger mechanism defined by the release levers (33), transfer element (35), and trigger (46) is adapted to be shifted between two end positions.

3. The pipette as claimed in claim 2 wherein a spring member (42) is provided which acts on the trigger mechanism at one end and on the pipette casing (2) at the other end, thus counteracting a trigger actuation.

4. The pipette as claimed in claim 1 wherein the transfer element (35) is passed along within the at least one guide (37) in parallel with the direction of displacement of the accommodating body (10) within the pipette casing (2).

5. The pipette as claimed in claim 1 wherein the transfer element (35) has at least two parallel rods (36) passed along within the at least one guide (37) and bridging members (38, 39) that connect them at the ends.

6. The pipette as claimed in claim 5 wherein at least one bridging member (39) facing the release levers (33) has the abutment area (40).

7. The pipette as claimed in claim 1 wherein the trigger (46) is laterally projecting from the pipette casing (2) transversely to the at least one guide (37).

8. The pipette as claimed in claim 1 wherein the trigger (46) is disposed in the vicinity of that end of the pipette casing (2) which is remote from the seat (4).

9. The pipette as claimed in claim 1 wherein the transfer element (35) is joined to the trigger (46) via an actuation rod (44).

10. The pipette as claimed in claim 1 wherein the transfer element (35) has a trunnion (41) in parallel with the guide (37) on which a coil spring type member (42) is guided.

11. The pipette as claimed claim 1 wherein each syringe gripping lever (19) has two release levers (33).

12. The pipette as claimed in claim 1 wherein the release levers (33), when in a non-actuated condition, are inclined at an acute angle from the at least one guide (37) of the transfer element (35).

13. The pipette as claimed in claim 1 wherein the release levers (33) have roundings (34) at the ends.

14. The pipette as claimed in claim 1 wherein the seat (4) has disposed therein a spring-loaded abutment (9) onto which the mounting portion (5) of the syringe (6) is adapted to be pressed by the syringe gripping levers (19).

15. The pipette as claimed in claim 1 wherein the trigger (46) has a trigger button which outwardly projects from the pipette casing (2) and is adapted to be displaced via a manual actuation.

16. The pipette as claimed in claim 1 which has an electric driving motor for the trigger that is coupled to the trigger.

17. The pipette as claimed in claim 1 which has an electric driving motor for the piston adjusting device that is coupled to the piston adjusting device.

18. The pipette as claimed in claim 1 which is a hand-carried pipette.

19. The pipette as claimed in claim 1 which is a stationary pipette.

* * * * *